US009572732B2

(12) United States Patent
Beeri

(10) Patent No.: US 9,572,732 B2
(45) Date of Patent: Feb. 21, 2017

(54) DEVICES FOR ENABLING MOVEMENT OF A WHEELCHAIR ON STAIRS AND A WHEELCHAIR INCLUDING THE DEVICES

(71) Applicant: Shmuel Beeri, Ramat Gan (IL)

(72) Inventor: Shmuel Beeri, Ramat Gan (IL)

( * ) Notice: Subject to any disclaimer, the term of this patent is extended or adjusted under 35 U.S.C. 154(b) by 0 days.

(21) Appl. No.: 14/405,523

(22) PCT Filed: Jun. 11, 2013

(86) PCT No.: PCT/IL2013/050472
§ 371 (c)(1),
(2) Date: Dec. 4, 2014

(87) PCT Pub. No.: WO2013/183044
PCT Pub. Date: Dec. 12, 2013

(65) Prior Publication Data

US 2015/0173986 A1 Jun. 25, 2015

Related U.S. Application Data

(60) Provisional application No. 61/655,129, filed on Jun. 4, 2012.

(51) Int. Cl.
*A61G 5/06* (2006.01)
*A61G 5/10* (2006.01)

(52) U.S. Cl.
CPC ..... *A61G 5/061* (2013.01); *A61G 5/068* (2013.01); *A61G 5/104* (2013.01)

(58) Field of Classification Search
CPC ..... A61G 5/061; A61G 5/068; A61G 5/06
USPC ..... 280/5.22, 5.28
See application file for complete search history.

(56) References Cited

U.S. PATENT DOCUMENTS

| | | | | |
|---|---|---|---|---|
| 3,133,742 | A * | 5/1964 | Richison | A61G 5/061 280/11 |
| 3,178,193 | A * | 4/1965 | Grogan | A61G 5/061 280/11 |
| 4,618,155 | A * | 10/1986 | Jayne | A61G 5/023 180/8.2 |
| 4,811,966 | A | 3/1989 | Singleton | |
| 4,962,942 | A | 10/1990 | Barnett | |
| 5,228,709 | A | 7/1993 | Kao | |
| 6,341,784 | B1 * | 1/2002 | Carstens | A61G 5/061 180/8.2 |
| 6,378,883 | B1 * | 4/2002 | Epstein | A61G 5/04 180/6.5 |
| 8,167,317 | B2 | 5/2012 | Fast | |
| 2004/0021300 | A1 * | 2/2004 | Tsai | A61G 5/08 280/642 |

FOREIGN PATENT DOCUMENTS

| | | |
|---|---|---|
| CN | 102357049 | 2/2012 |
| CN | 202179644 | 4/2012 |
| EP | 1894809 | 5/2008 |

* cited by examiner

*Primary Examiner* — Anne Marie Boehler
*Assistant Examiner* — Felicia L Brittman
(74) *Attorney, Agent, or Firm* — Robert G. Lev

(57) ABSTRACT

A device comprising: a hollow sleeve; and a leg slidable in the sleeve; the leg having a retracted position in the sleeve and an extended position in the sleeve, the leg having one or more auxiliary wheels or a continuous track at an end of the leg; the device being configured for attachment to a wheelchair between a front wheel of the wheelchair and a back wheel of the wheelchair.

19 Claims, 10 Drawing Sheets

DEVICES FOR ENABLING MOVEMENT OF A WHEELCHAIR ON STAIRS AND A WHEELCHAIR INCLUDING THE DEVICES

PRIORITY INFORMATION

This National Stage Application claims priority to U.S. Provisional Patent Application No. 61/655,129, filed on Jun. 4, 2012, and PCT Application No: PCT/IL2013/050472, filed on Jun. 11, 2013.

TECHNOLOGICAL FIELD

This invention relates to wheelchairs, and more specifically to devices for facilitating movement of a wheelchair between two levels.

BACKGROUND

Wheelchairs are commonly used to assist individuals whose ability to walk is impaired, or who are completely unable to walk. When the individual seated in the wheelchair has use of his or her hands, he or she can propel himself or herself in the wheelchair by means of hand rings attached to the rear wheels of the wheelchair. Hand grips are also provided in the rear of the wheelchair to allow a caregiver to push the wheelchair.

When a wheelchair arrives at step, it becomes necessary to raise or lower the wheelchair together with the individual seated in the wheelchair. Various devices have been proposed for facilitating the movement of a wheelchair up or down a step.

U.S. Pat. No. 4,962,942, for example, discloses a wheelchair which can negotiate curbs and other obstructions. The wheelchair has first auxiliary support wheels located between the front and rear wheels, and second auxiliary wheels behind the rear wheels. The front wheels and the rear wheels are structured to be raised or lowered by the wheelchair occupant. When a curb is encountered, the occupant propels the wheelchair forwardly until the first auxiliary wheels are at the edge of the curb, and the front wheels are suspended in air. The front wheels are then lowered to the bottom of the curb and the wheelchair is propelled forward until the second auxiliary wheels are at the curb edge. The large rear wheels are then lowered to curb level, and the wheelchair is propelled by the occupant to the opposite curb, where the curb is ascended by turning the wheelchair 180° and performing the wheel adjusting process in the opposite sequence.

Wheelchairs designed for assisting in negotiating a step are also disclosed in Chinese Patent CN202179644, and U.S. Pat. Nos. 4,811,966, 5,228,709, 8,167,317.

GENERAL DESCRIPTION

In one of its aspects, the present invention provides a device for facilitating movement of the wheelchair at a step. In use, the device of the invention is positioned on a wheelchair between a front wheel and a rear wheel and comprises a hollow sleeve and a leg slidable in the sleeve between a retracted position and an extended position. The leg is maintained in the retracted position when the wheelchair is moving on a level floor and brought to the extended position when it is desired to ascend or descend stairs, as explained in detail below.

The invention also provides a wheelchair comprising one or more of the devices of the invention. The devices may be integral with the wheelchair, or may be installed on a previously existing wheelchair. The wheelchair may have hand grips having an adjustable height. The wheelchair of the invention may further comprise a driving lever on one or both rear wheels that allows a person seated in the wheelchair to propel himself. As shown below, the lever effect reduces the force required to manually propel the wheelchair.

The wheelchair of the invention may be motorized. In this embodiment an outer gear ring is attached to the inside rim of a rear wheel. A battery operated motor located under the seat has a driving gear on the motor shaft that drives the outer gear ring and turns the rear wheel. A joystick mounted on the wheelchair may be used to steer the wheelchair.

BRIEF DESCRIPTION OF THE DRAWINGS

In order to understand the disclosure and to see how it may be carried out in practice, embodiments will now be described, by way of non-limiting example only, with reference to the accompanying drawings, in which.

DETAILED DESCRIPTION OF EMBODIMENTS

Figure 1:
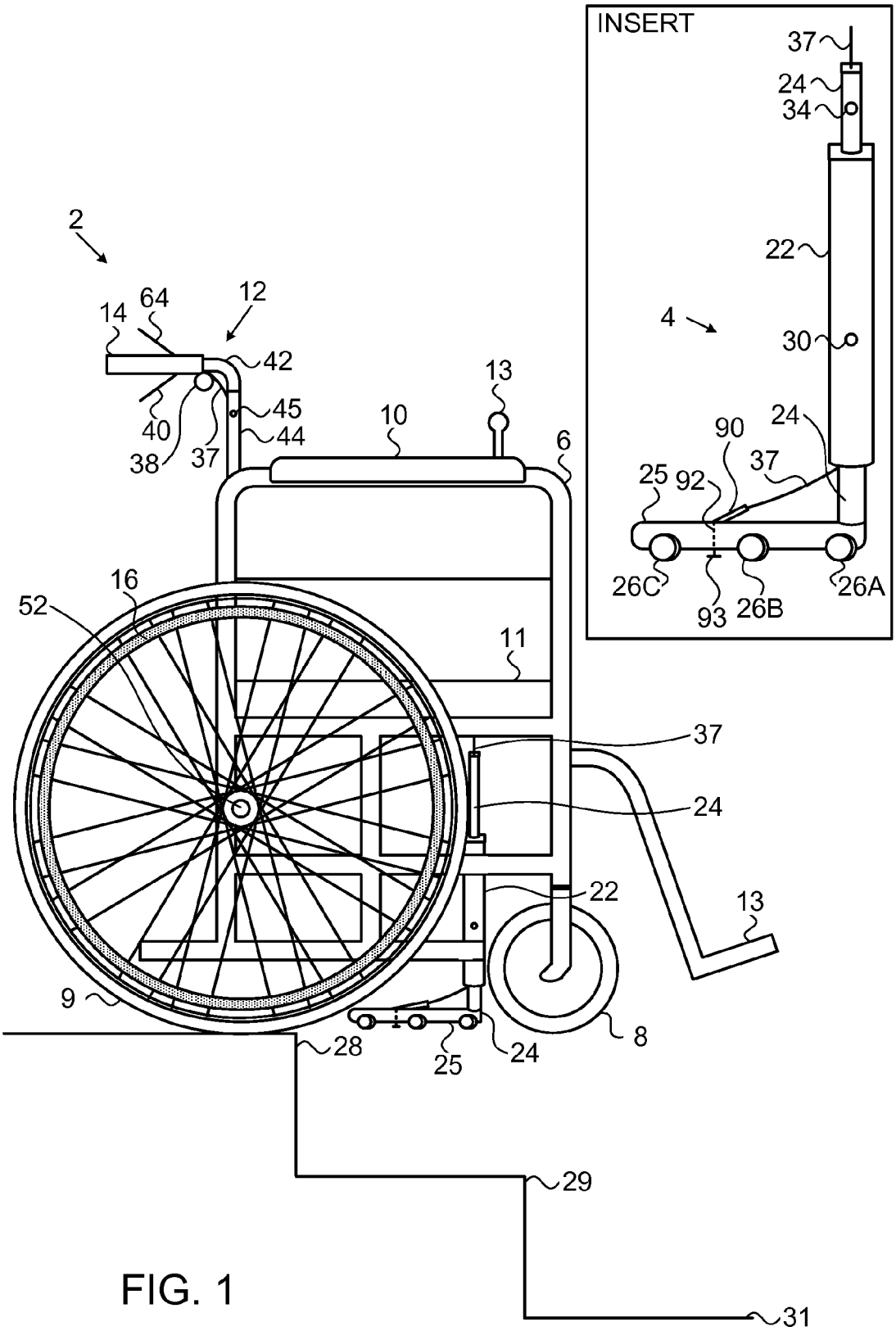
FIG. 1 shows a wheelchair at the top of a set of stairs with the leg in retracted position.

FIGS. 1 to 4 show a wheelchair 2 in which one or more devices 4 for facilitating movement of the wheelchair at a step has been installed. The wheelchair 2 comprises a carriage frame 6, left and right front caster wheels 8, and left and right rear wheels 9. The frame 6 has a seat 11, arm rests 10, a back 12, foot rest 13 and left and right hand grips 14. The rear wheels 9 have a hand rim 16 by which an individual seated in the wheelchair 2 can propel himself in the wheelchair if he has full use of his hands.

The hand grips 14 of the wheelchair may have a selectable height. In this case, the each hand grip 14 is connected to a curved tube 42 that is slidable in an outer sleeve 44. The curved leg or tube 42 can be locked in any desired position by manually turning a locking screw 45.

The device 4 of the invention is shown enlarged in the inserts to FIGS. 1 to 4. Each device 4 of the invention is positioned between a front wheel and a rear wheel, and forward from the handgrips 14. Each device 4 comprises a hollow sleeve 22 and a hollow leg 24 that is slidable in the sleeve 22. The leg 24 has a retracted position in the sleeve 22 shown in FIGS. 1 and 4, and an extended position in the sleeve 22 shown in FIGS. 2 and 3. The leg 24 is bent near its bottom end to form a foot 25. The foot 25 comprises auxiliary wheels 26*a*, 26*b*, and 26*c*. Alternatively, instead of wheels, the foot may comprise a continuous track. The sleeve 22 is provided with a spring loaded pin 30 that fits into a bottom hole 32 in the wall of the leg 24 when the leg 24 is in the retracted position, and a top hole 34 in the wall of the leg 24, when the leg 24 is in the extended position. This allows the leg to be locked in the extended and retracted positions.

The wheelchair 2 includes a hand brake 40 adjacent to one or both of the hand grips 14 that are used to lock the rear wheels 9 of the wheelchair 2. The auxiliary wheels 26*a*, 26*b*, and 26*c* are also connected to the hand brake 40 by means of a cable 37. Depressing the hand brake 40 raises a lever 90 on the foot 25 of the device 4 which causes a rod 92 to lower and depress a pad 93 that presses on the floor and brakes the foot 25 when the foot is on a floor or other surface.

Figure 5A:
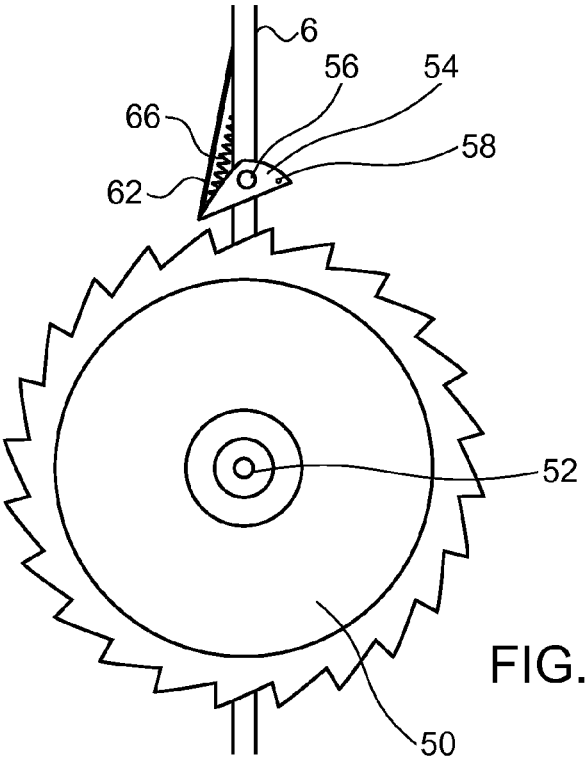
FIG. 5A shows a ratchet wheel and a pawl in a non-engaging position.
Figure 5B:
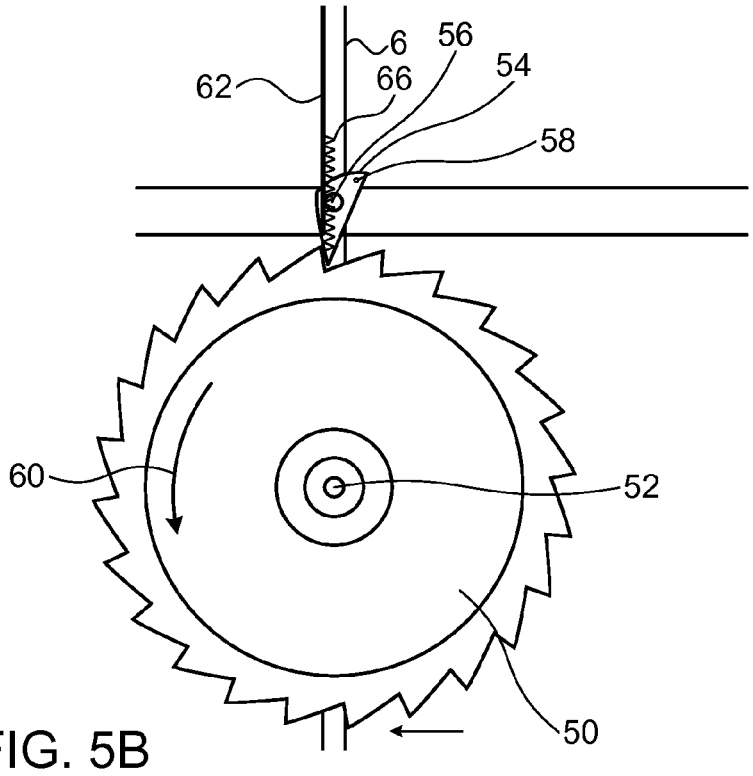
FIG. 5B shows the ratchet wheel and a pawl in an engaging position.

FIG. 5 shows the axle 52 of the rear wheel 9 in greater detail. For the sake of clarity, the spokes of the rear wheel 9 are not shown in FIG. 5. The wheelchair 2 is provided with a ratchet wheel 50 attached to the axle 52 at one or both rear wheels 9. A pawl 54 is rotatable on a pivot 56 attached to the frame 6 of the wheelchair 2. The pawl 54 can be locked in a non-engaging position shown in FIG. 6*a* by means of a locking screw 58 in which the rear wheel 9 can turn in either direction. The pawl 54 can alternatively be released into an engaging position shown in FIG. 6*b* in which the rear wheel 9 can turn only in the direction indicated by the arrow 60. The pawl 54 is spring biased in the engaging position by means of a spring 66 that is attached at one end to the pawl 54 and at another end to the frame 6 of the wheelchair 2. The pawl 54 is attached to a cable 62. Depressing a lever 64 on one or both hand grips 14 raises the pawl 54 from the engaging position to the non-engaging position, which allows maneuvering of the wheelchair 2. When the lever 64 is released, the pawl 54 returns to the engaging position under the influence of the spring 66.

Figure 6:
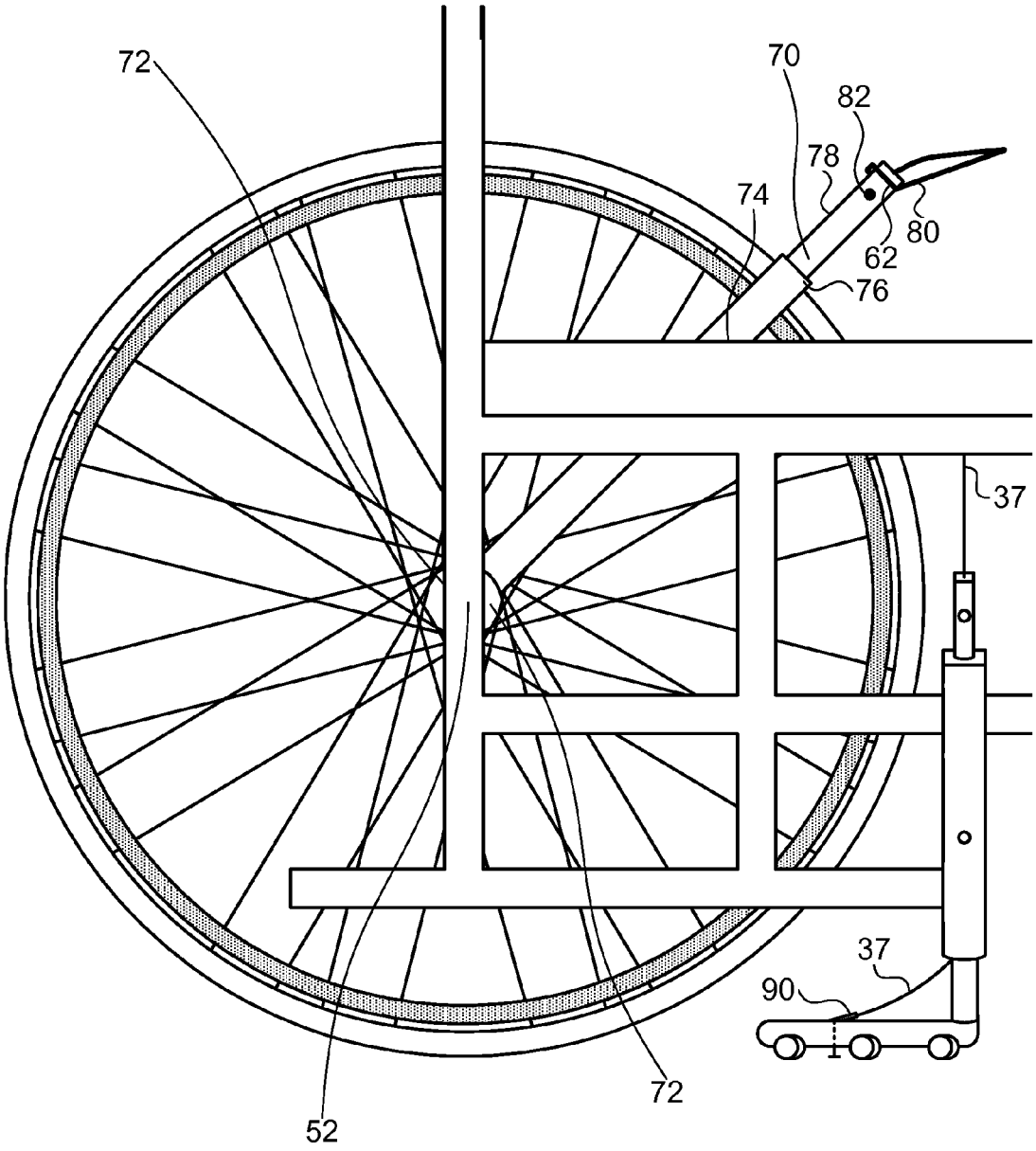
FIG. 6 shows a driving arm attached to rear wheel of a wheelchair.
Figure 7:
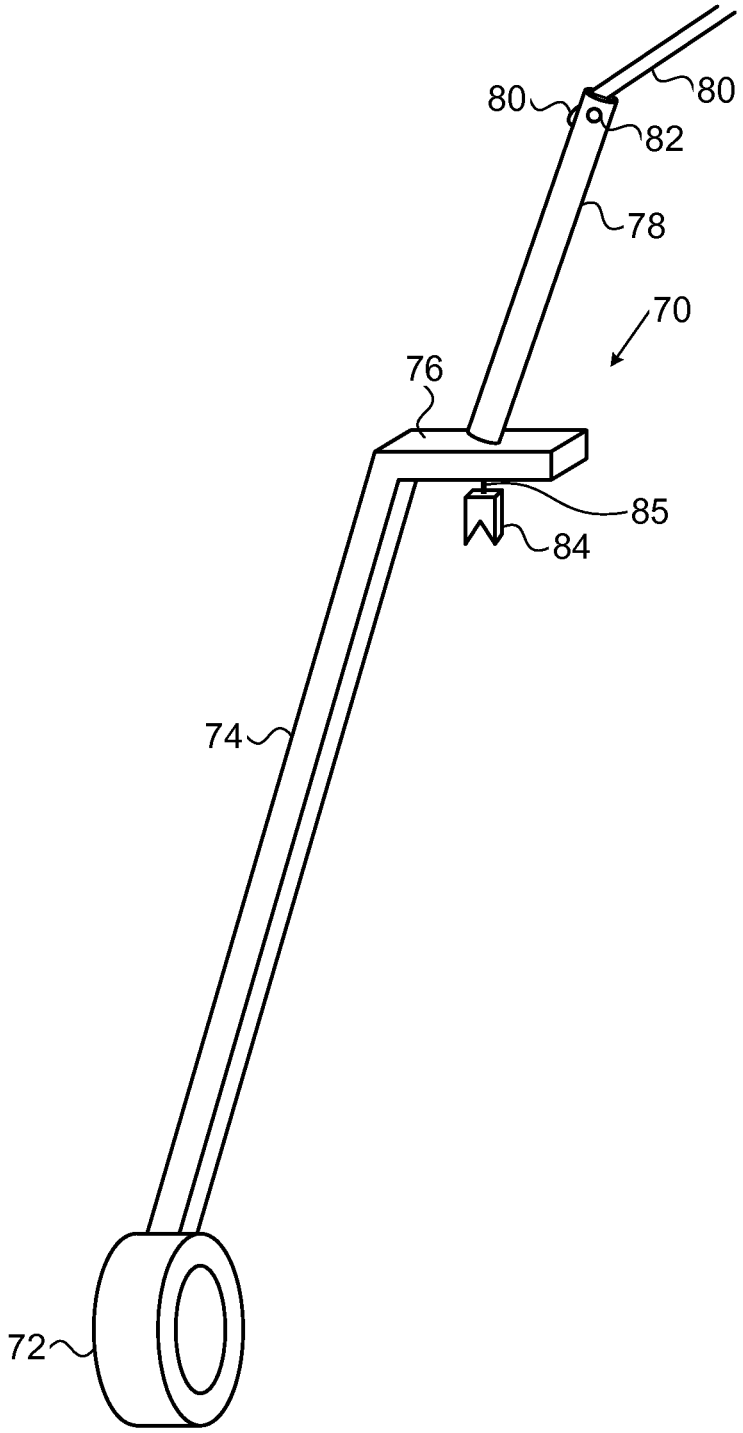
FIG. 7 shows the driving arm of FIG. 6.

FIG. 6 shows the rear wheel 9 in greater detail. The wheelchair 2 is provided with a pair of driving levers 70 shown in greater detail in FIG. 7. The driving lever 70 comprises a rim 72 that is mounted on the axle 52 of one of the rear wheels 9 of the wheelchair 2. The driving lever 70 can be mounted on either side of the wheel, but is preferably mounted on the inside of the wheel 9, between the wheel 9 and the frame 6. A rod 74 extends from the rim 72 to a surface 76 that is essentially perpendicular to the rod 74. A sleeve 78 extends from the surface 76 and is provided at a free end with a lever 80 that pivots on a pivot 82. The lever 80 is coupled to a friction clutch 84 by means of a rod or cable 85. Depressing the lever 80 causes the friction clamp 84 to press on the tire of the rear wheel 9, so that rotating the driving lever 70 about the axle 52, in either direction, with the lever 80 depressed causes the rear wheel 9 to rotate. Grasping the tire of the wheel by the lever 70 imitates direct manual rotation of the wheel by an individual in the wheelchair grasping the rim of the wheel, but requires significantly less force than manual rotation.

Figure 2:
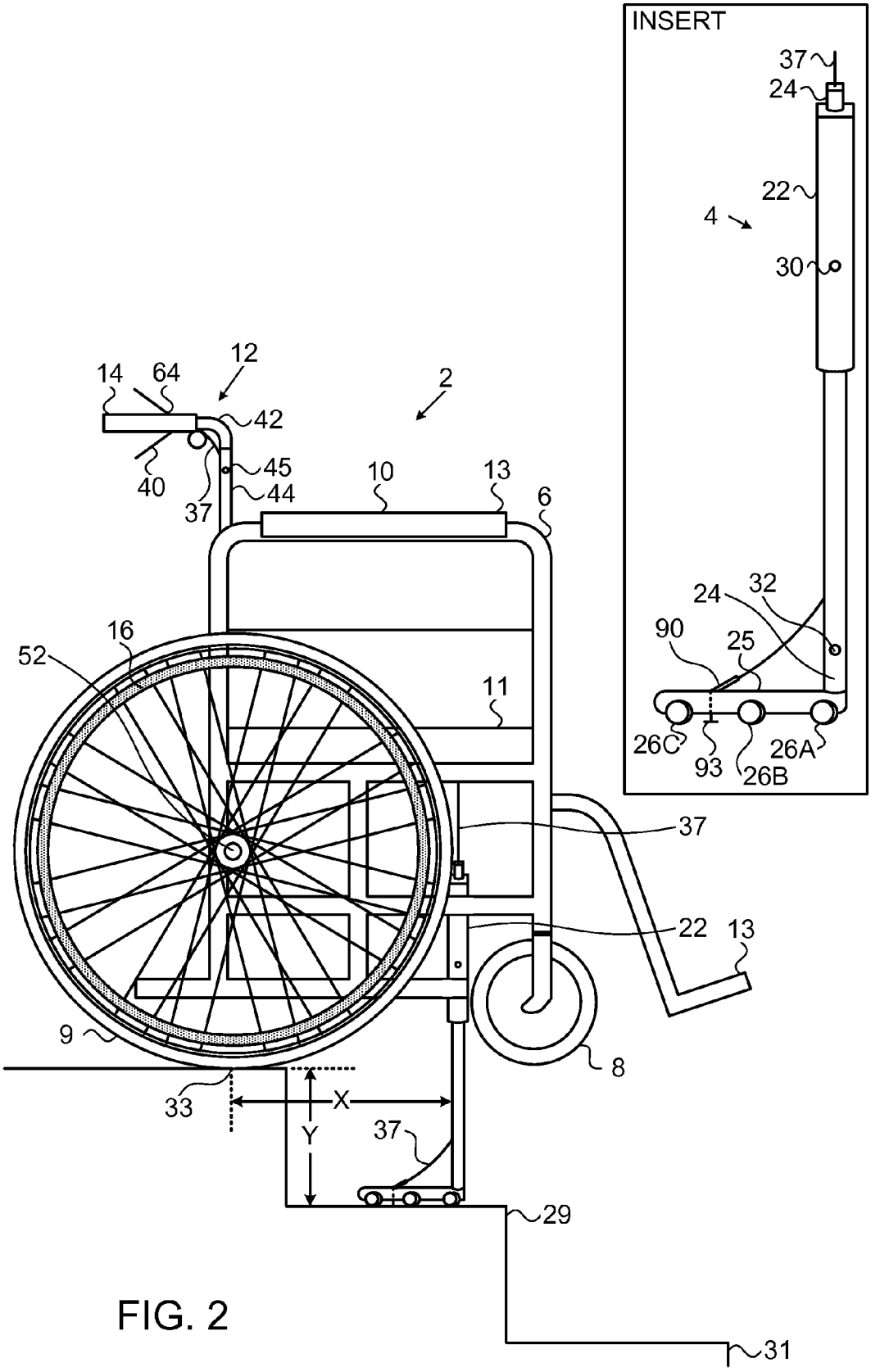
FIG. 2 shows the wheelchair of FIG. 1 at the top of a set of stairs with the leg an extended position.
Figure 3:
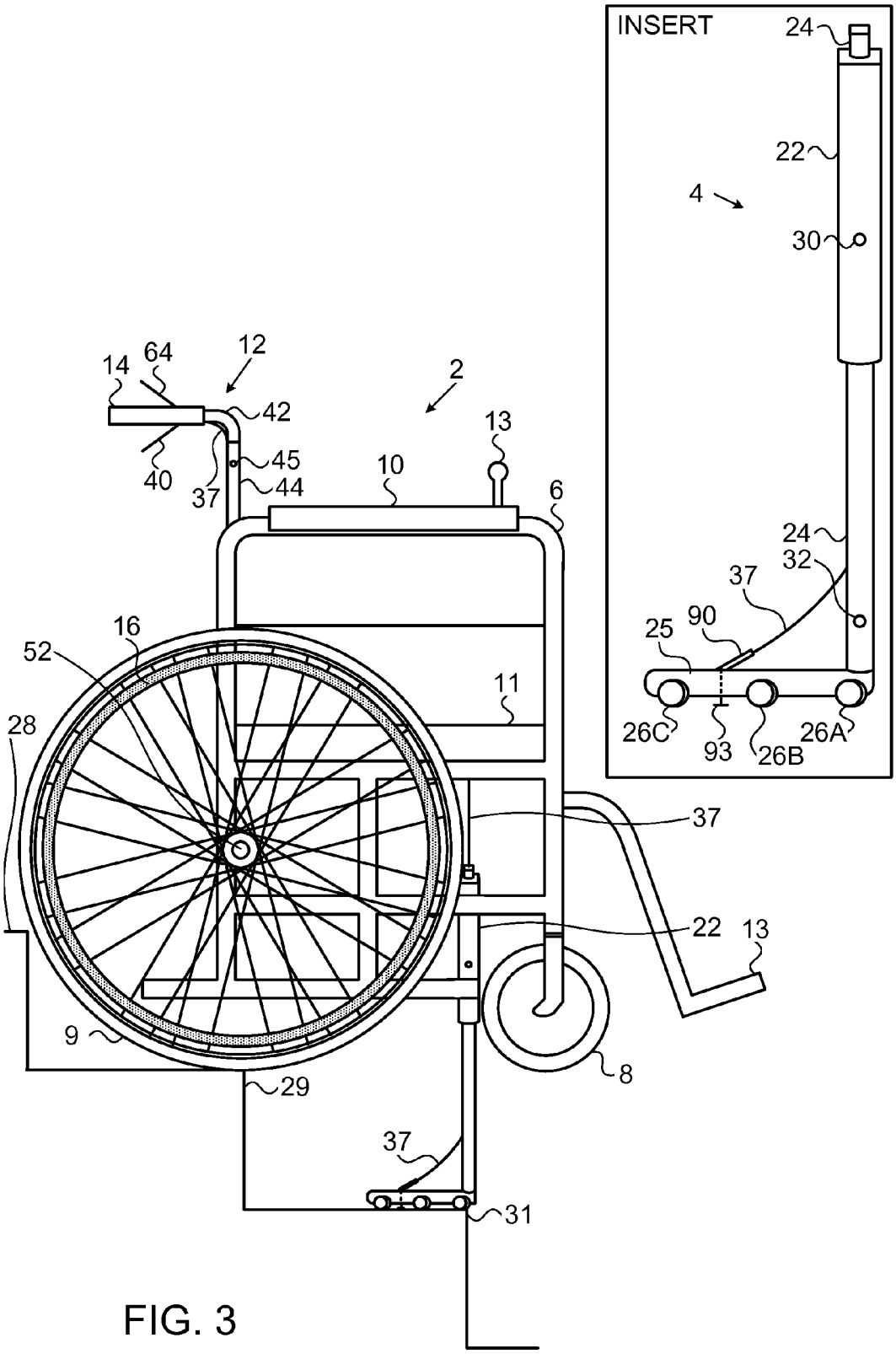
FIG. 3 shows the wheelchair of FIG. 1 after descending one step with the leg an extended position.

Referring again to FIGS. 1 to 4, the leg 24 is maintained in the retracted position when the wheelchair 2 is moving on a level floor. When the chair is, for example, to descend a set of stairs, the rear wheels 9 are brought near to the edge of the top step 28 (FIG. 1). The leg 24 is then made to move from the retracted position (FIG. 1) to the extended position (FIG. 2). The leg of each device 4 is connected via a cable 37 to a leg release ring 38 located adjacent to a hand grip 14. Pulling on the ring 38 causes the leg 24 to drop down under the influence of gravity from the retracted position to the extended position, when the front of the wheelchair is over a lower step, as shown in the FIG. 2. In this configuration, the rear wheels are in contact with the top step 28, the auxiliary wheels are in contact with the next step 29, and the front wheels 8 are suspended in the air Referring to FIG. 2, in the extended position of the leg 24, the auxiliary wheels 26 are positioned a distance y below the bottom of the front and back wheels. The distance y is preferably selected to be about equal to the height of a typical step, which is around 17 to 18 cm. The device 4 is positioned in front of the contact point 33 of the rear wheel a distance x that is preferably selected to be about 7 cm larger than the depth of a typical step, which is around 27 to 28 cm. At this point, the brakes 40 may momentarily be applied in order to verify that the position of the wheelchair is under control. The brakes 40 are then released. With x and y selected as above, when the wheelchair is pushed forward from the position shown in FIG. 2, the rear wheels 9 descend from the top step 28 to the next step 29 at same time that the auxiliary wheel 26 descends from the step 29 to the next step 31 (FIG. 3). As the wheelchair descends, it is advisable to apply the brakes for better control of the movement of the wheelchair. This process can be repeated any number of times so that the wheelchair 2 can descend any number of steps.

Referring again to FIG. 2, the leg 24 may optionally be provided with an extension (not shown) that extends from the leg 24 and contacts the next lower step 31 when the auxiliary wheels 26*a*, 26*b*, and 26*c* are on the step 29. The extension may be provided with one or more wheels. Such an extension tends to enhance the stability of the wheelchair as the wheel chair descends the stairs.

Figure 4:
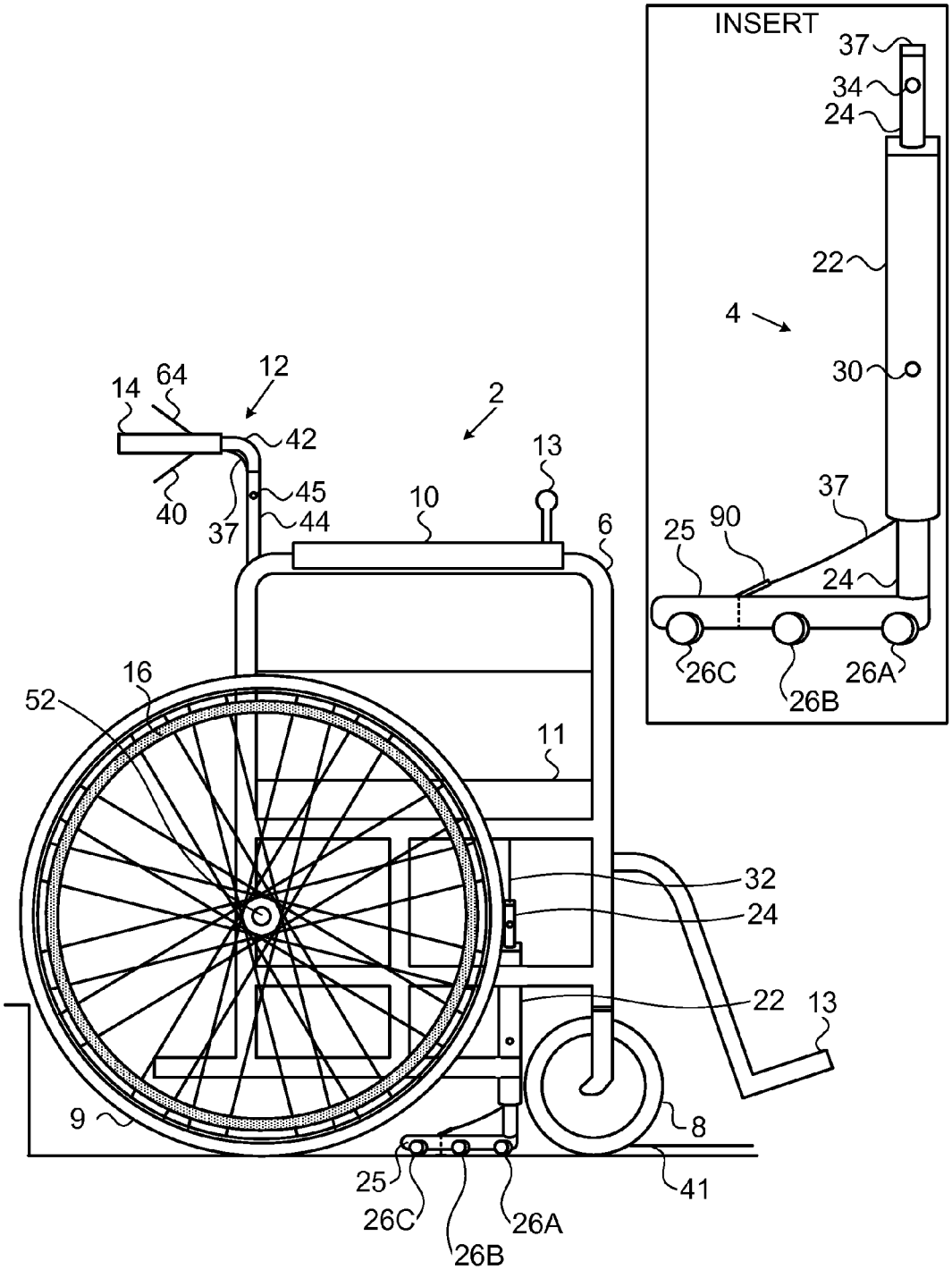
FIG. 4 shows the wheelchair of FIG. 1 after descending a set of stairs and arriving at a level floor.

Referring to FIG. 4, as the wheelchair 2 returns to a level floor 41 at the bottom of the stairs, the leg release ring 38 is pulled again and the leg 24 is pushed back into the sleeve by the floor. The leg 24 is then pushed up another centimeter or two, for example, by a caregiver's foot, until the spring loaded pin 30 of the sleeve is received again in the upper hole 32.

In another embodiment of the invention (not shown), a hydraulic, pneumatic or electronic piston is used to lower and raise the leg 24 of the device 4, instead of relying on gravity alone. Use of a piston to lower and raise the leg 24 provides control of the positioning of the leg 24 in the sleeve 22 which allows determination of the distance y between the auxiliary wheels 26*a, b*, and *c* and the bottom of the wheels 9 and 8 of the wheelchair, when the device 4 is in the extended configuration, to be equal to the height of the step to be ascended or descended.

In yet another embodiment of the invention (not shown), small electric motors are used to apply the brakes to the rear wheels 9, instead of cables. Similarly, small electric motors may be used to apply the brake pads 93 to the floor instead of cables, or to move the pawl 54 and/or the pins 30.

Figure 8:
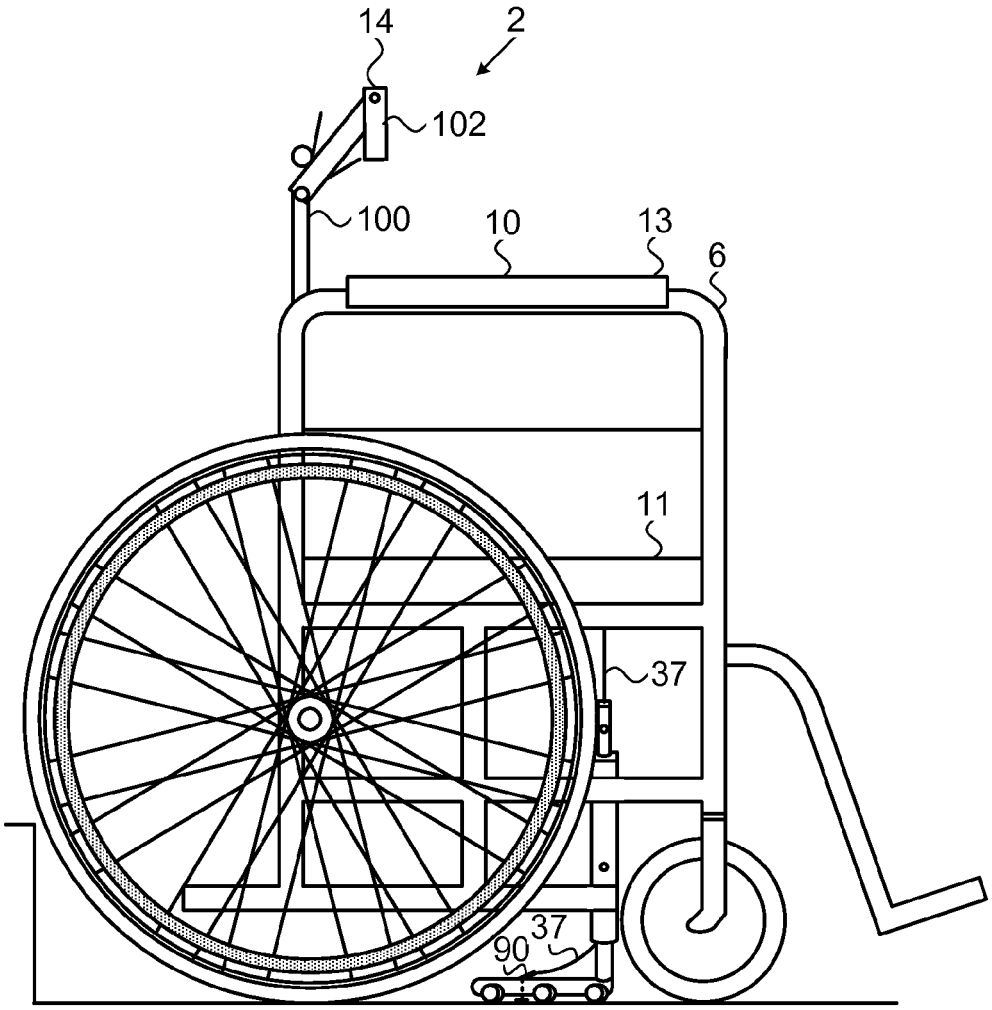
FIG. 8 shows a wheelchair having hand grips in the "B" configuration.

The hand grips 14 of the wheelchair 2 may be transformable from the configuration shown in FIGS. 2 to 4 (referred to herein as the configuration "A") to a configuration that is useful when the wheelchair 2 is to ascend a set of stairs (referred to herein as configuration "B"). As shown in FIGS. 2 to 4, in the A configuration, the handgrips 14 point in a rearward direction. The frame 6 is pivotable about a pivot 100 to bring the hand grips into configuration B, as shown in FIG. 8. An auxiliary handgrip 102 is pivotable about the main handgrip 14 to extend laterally outward from the handgrip 14 when the handgrip 14 is in the B configuration. As shown below, bringing the handgrips into the B configuration increases the lever effect and facilitates ascending a set of stairs by eliminating the need of a caregiver to bend down.

Figure 9:
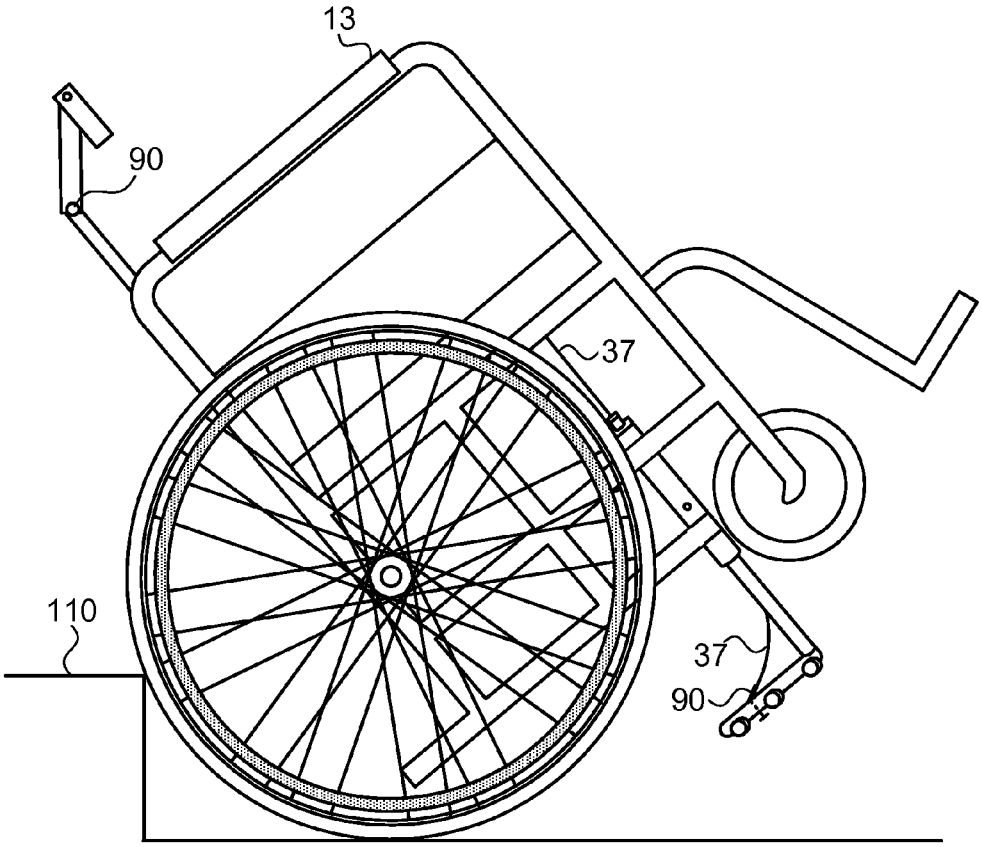
FIG. 9 shows a wheelchair before ascending a step.

When the wheelchair 2 is to ascend a set of stairs, the handgrips are first brought into the B configuration, as shown in FIG. 8. The legs of the devices 4 are then released by pulling on the rings 38. The pawl 54 is then brought to the non-engaging position by applying the lever 64, and the wheelchair 2 is then tilted backwards to an angle of about 45° (FIG. 9). The lever 64 is then released, bringing the pawl back to the engaging position. The wheelchair 2 is then pulled backwards, until the rear wheels 9 touch the bottom step 110. Tilting the wheelchair backwards lowers the center of gravity of the wheelchair-passenger combination, which reduces the force needed to raise the wheelchair over the step, by as much as 75%. The wheelchair 2 is then pulled up onto the bottom step 110. As the chair is being pulled up by a caregiver, the individual in the chair may assist by turning the rear wheels of the wheelchair, possibly using the driving levers. The process is repeated for each step in the set of stairs, until the wheelchair 2 arrives at the top of the stairs. At any time as the stairs are being ascended, when it is desired to rest, the brakes may be applied and the wheelchair 2 brought to an upright position with the auxiliary wheels 26*a*, 26*b* and 26*c* resting on the step below the step upon which the rear wheels 9 are resting. The pawl 54 is maintained in the engaging position during ascent of the stairs in order to prevent the wheelchair 2 from slipping downwards.

The invention also provides a wheelchair comprising one or more of the devices 4. The devices 4 may be integral with the wheelchair, or may be installed on a previously existing wheelchair.

Figure 10:
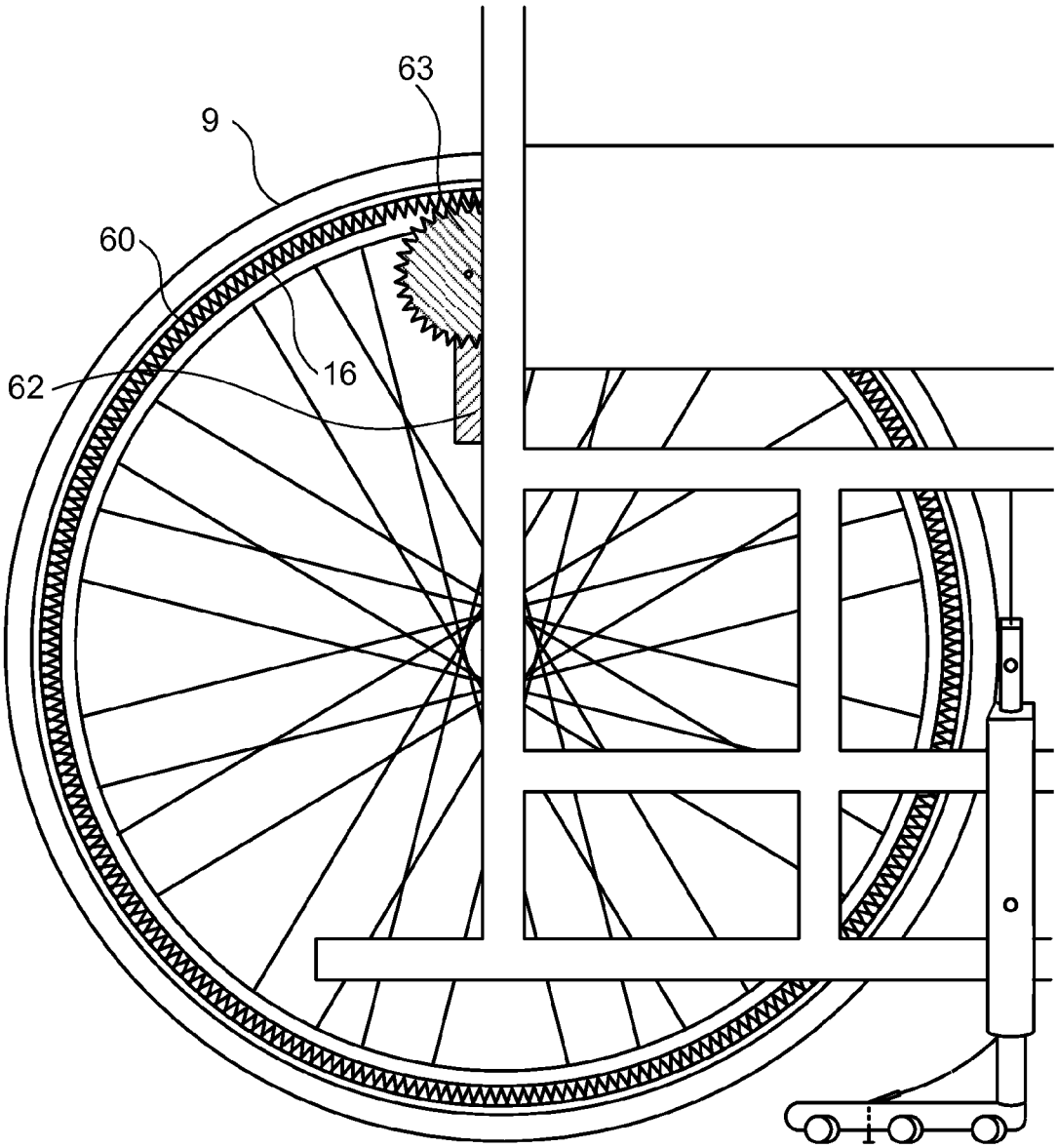
FIG. 10 shows a rear wheel of a motorized wheelchair.

The wheelchair 2 may be motorized in which case, assistance of the individual in the chair during the ascent of stairs is not necessary. As shown in FIG. 10, in a motorized embodiment, an outer gear ring 60 is attached to the inside rim of a rear wheel 9. A battery operated motor 62 located under or behind the seat has a driving gear 63 on the motor shaft that drives the outer gear ring 60 and turns the rear wheel 9. For the sake of clarity, parts of the wheel 9 in the vicinity of the motor 62 have been removed in FIG. 10. When the wheelchair is being tilted backwards, the motor gear should be disengaged from the outer gear ring 50. The driving gear 63 is then re-engaged in the inner gear ring and the motor is then briefly activated just to raise the wheelchair 2 over a step. The inventor has found that driving the wheel from the gear ring on the wheel rim requires a power that is about 10% of the power required to drive the wheel from near the wheel axis, which allows a lighter motor to be used. For example, two motors, one on each wheel, having a torque of 14-24 N-m are adequate for the task. Such motors are typically around 12 cm in length and 3 cm in diameter. The motor is positioned so as not to interfere with the folding of the wheelchair. In a motorized embodiment, when the motor is not active, the wheel is braked, so that the ratchet wheel 50 and the pawl 54 may be omitted. Operation of the motors can be via a control device located on or adjacent to the handgrips. A, alternatively, as shown in FIGS. 1 to 4, operation of the motor 62 may be under the control of a control device, such as a joystick 13, positioned on an arm 10 of the wheelchair.

During descent of the wheelchair 2 on stairs, the motor is not utilized, and the motor gear 63 should be disengaged from the gear ring on the wheels.

The invention claimed is:

1. A stabilizing device configured to interface with and operate in conjunction with the operation of a wheelchair, the wheelchair having a longitudinal axis and a lateral axis, the wheelchair further having front wheels with rotational axes and rear wheels with rotational axes, said front wheels and said rear wheels being separated from each other along said longitudinal axis of said wheelchair, said stabilizing device comprising:

a) a hollow sleeve;

b) a leg slidable in the sleeve; said leg having a retracted position in the sleeve and an extended position in the sleeve, said leg having a foot substantially perpendicular to said leg, said foot having a plurality of auxiliary wheels spaced along the length of said foot; and, c) said stabilizing device being configured for attachment to said wheelchair, so as to be longitudinally spaced between the front wheels of the wheelchair and the back wheels of the wheelchair, said stabilizing device being configured so that said foot extends parallel to the longitudinal axis of the wheelchair, and rotational axes of said auxiliary wheels are parallel to said axes of the front wheels and rear wheels of the wheelchair.

2. The device according to claim 1 further comprising means for reversibly locking the leg in the extended position and further comprising means for reversibly locking the leg in the retracted position.

3. The device according to claim 2 wherein the means for reversibly locking the leg in the extended position and reversibly locking the leg in the retracted position comprises a spring loaded pin provided on the sleeve, an upper hole and a lower hole provided in a wall of the leg, wherein the spring loaded pin is engaged in the upper hole of the sleeve when the leg is in the extended position and the spring loaded pin is engaged in the lower hole when the leg is in the retracted position.

4. The device according to claim 3 wherein the means for reversibly locking the leg in the extended position and reversible locking the leg in the retracted position are mechanical or electrical means adapted to retract the spring loaded pin.

5. The device according to claim 3 wherein the means for reversibly locking the leg in the extended position and reversibly locking the leg in the retracted position comprises a piston.

6. The device according to claim 1 wherein one or more of the auxiliary wheels are positioned a distance below the bottom of the front and back wheels of the wheelchair in a range from 17 to 18 cm when the device is in the extended position.

7. The device according to claim 1 wherein, the device is configured to be positioned on a wheelchair a distance of about 35 cm from the bottom of the rear wheel.

8. The device according to claim 1 further comprising a brake on the auxiliary wheels.

9. A wheelchair comprising one or more of the devices according to claim 1.

10. The wheelchair according to claim 9 further comprising hand grips that are pivotable upwards around a first pivot and pivotable laterally around a second pivot.

11. The wheelchair according to claim 9 further comprising hand grips having a selectable height.

12. The wheelchair according to claim 9 further comprising one or more driving levers.

13. The wheelchair according to claim 9, further comprising a motor for rotating one or more wheels of the wheelchair.

14. The wheelchair according to claim 13 further comprising an outer gear ring attached to an inside rim of a rear wheel, and wherein the motor has a driving gear on a motor shaft that drives the outer gear ring and turns the rear wheel.

15. The wheelchair according to claim 14 further comprising a controlling device is located adjacent to a handgrip or arm of the wheelchair.

16. The wheelchair according to claim 14 comprising a control device adapted to engage the motor with the driving gear and to disengage the motor from the driving gear.

17. The wheelchair according to claim 14 having a pawl biased in the engaging position.

18. The wheelchair according to claim 13 further comprising a controlling device for controlling the motor.

19. The wheelchair according to claim 9 further comprising:

a) a ratchet wheel attached to an axle of a wheel of the wheelchair; and b) a pawl, the pawl being rotatable on a pivot between an engaging position in which the wheel can turn only in one direction and a non-engaging position in which the wheel can turn in either direction.

* * * * *